US005564276A

United States Patent [19]

Abadilla et al.

[11] Patent Number: 5,564,276

[45] Date of Patent: Oct. 15, 1996

[54] MICRO-CLIMATE CONDITIONING UNIT

[75] Inventors: Thomas T. P. Abadilla, Vallejo; Kelly J. Drake, Fremont, both of Calif.

[73] Assignee: United Defense, L.P., Arlington, Va.

[21] Appl. No.: 394,096

[22] Filed: Feb. 24, 1995

[51] Int. Cl.[6] ..... F25B 21/02

[52] U.S. Cl. ..... 62/3.7; 62/3.3; 62/3.5; 136/204

[58] Field of Search ..... 62/3.2, 3.3, 3.5, 62/3.7; 136/204, 205

[56] References Cited

U.S. PATENT DOCUMENTS

| | | | |
|---|---|---|---|
| 2,928,253 | 3/1960 | Lopp et al. | 62/3.3 |
| 3,031,855 | 5/1962 | Martz et al. | 62/3.3 |
| 3,077,080 | 2/1963 | Pietsch | 62/3.3 |
| 3,107,324 | 10/1963 | Wright et al. | 62/3.7 |
| 3,111,008 | 11/1963 | Nelson | 62/3.3 |
| 3,330,970 | 1/1967 | Wennerberg et al. | 62/3.7 |
| 3,399,536 | 9/1968 | Walz | 62/3.2 |
| 4,829,771 | 5/1989 | Koslow et al. | 62/3.64 |
| 5,097,828 | 3/1992 | Deutsch | 128/399 |

*Primary Examiner*—William Doerrler
*Attorney, Agent, or Firm*—Michael B. K. Lee; Douglas W. Rudy

[57] ABSTRACT

The invention provides a micro-climate control unit. The invention uses a thermoelectric stack to provide both heating and cooling of a temperature controlled element. The heating and cooling uses a temperature controller which senses the need for heating or cooling and provides the current to the thermoelectric stack which provides heating or cooling. The thermoelectric stack is improved by the use of a hard spacer.

11 Claims, 5 Drawing Sheets

MICRO-CLIMATE CONDITIONING UNIT

The invention relates to a micro-climate conditioning unit using a thermoelectric cooling and heating systems. In the prior art, thermoelectric cooling devices such as the device described in U.S. Pat. No. 4,829,77I incorporated by reference, used a stack of thermoelectric cooling modules spaced from each other by elastomeric material.

The invention provides an improved means for spacing thermoelectric modules. In addition the invention provides an improved electrical controller to provide thermoelectric heating and cooling in a micro-climate conditioning unit.

FIG. 6 is a schematic view of the temperature controller.

DESCRIPTION OF THE PREFERRED EMBODIMENT

Figure 1:
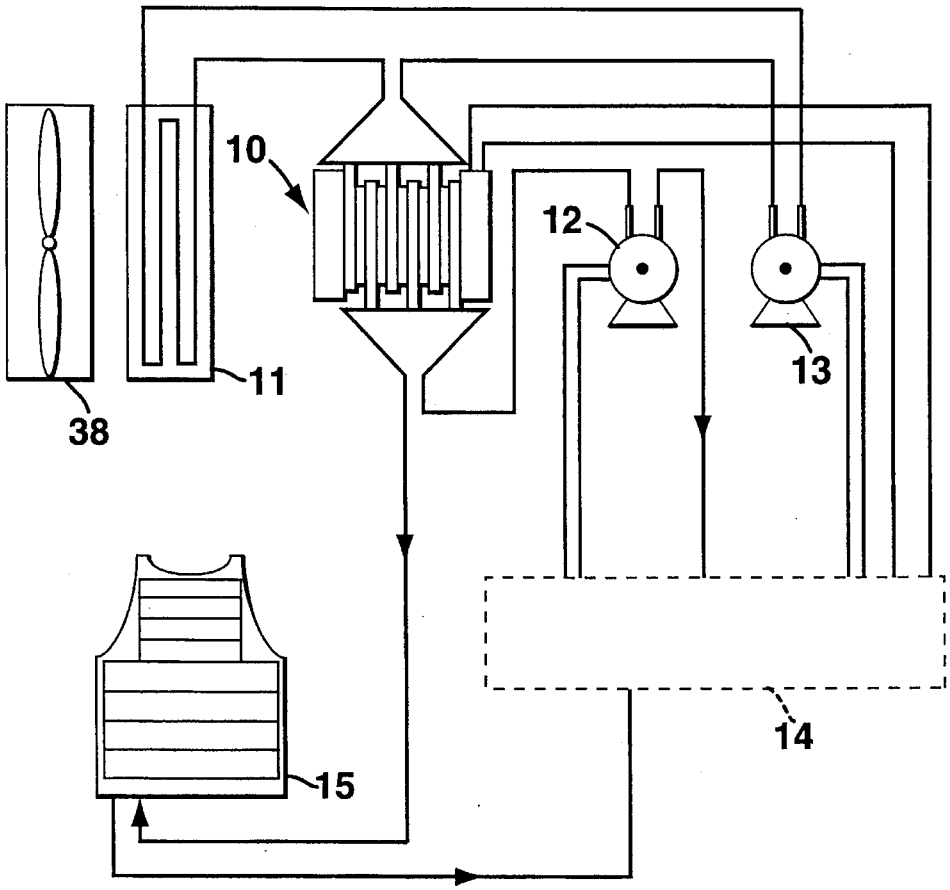
FIG. 1 is a schematic view of the inventive micro-climate conditioning unit.

A preferred embodiment of the inventive micro-climate conditioning unit as shown in FIG. 1, comprises a thermoelectric stack 10, a heat exchanger 11, a first fluid pump 12, a second fluid pump 13, a temperature controller 14, and a temperature controlled element 15.

Figure 2:
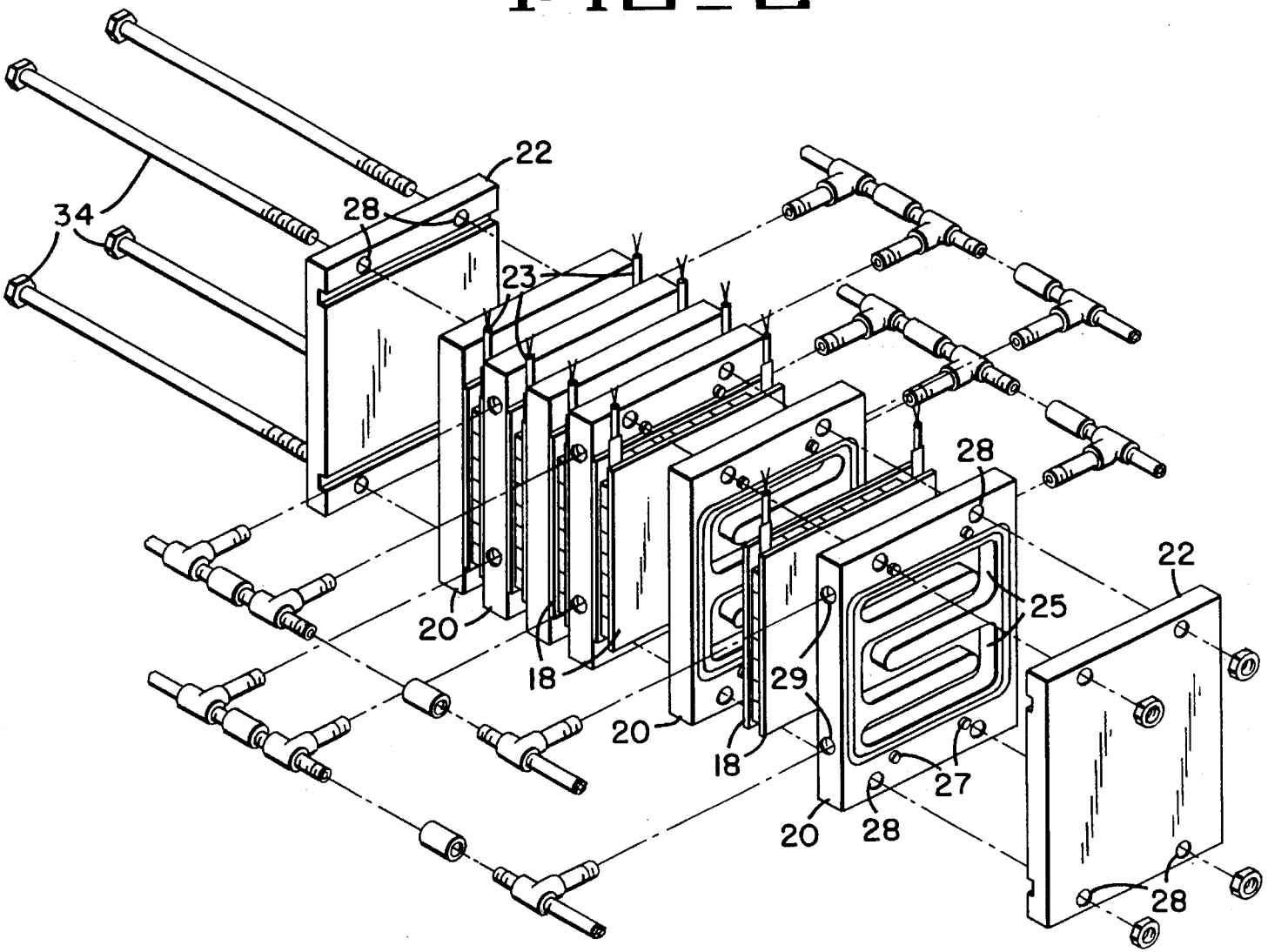
FIG. 2 is an exploded view of a thermoelectric stack.

FIG. 2 is an exploded view of the thermoelectric stack 10. The thermoelectric stack comprises a plurality of rectangular, commercially available thermoelectric modules 18 alternating with spacers 20 and terminating with end plates 22. Each module has a first temperature surface and a second temperature surface and a pair of surface electrical leads 23. The thermoelectric modules 18 are arranged in the thermoelectric stack 10, so that first temperature surfaces are adjacent to another first temperature surface and second temperature surfaces are adjacent to another second temperature surface. Thus, each spacer 20 is sandwiched between either two first temperature surfaces or two second temperature surfaces. One such thermoelectric module is the CP5-31-06L of Materials Electronic Products Corp. It is described by the manufacturer as being solderable, ceramic insulated, thermoelectric modules. Each module contains 31 couples. The thermoelectric material is a quaternary alloy of bismuth, tellurium, selenium, and antimony.

Figure 3:
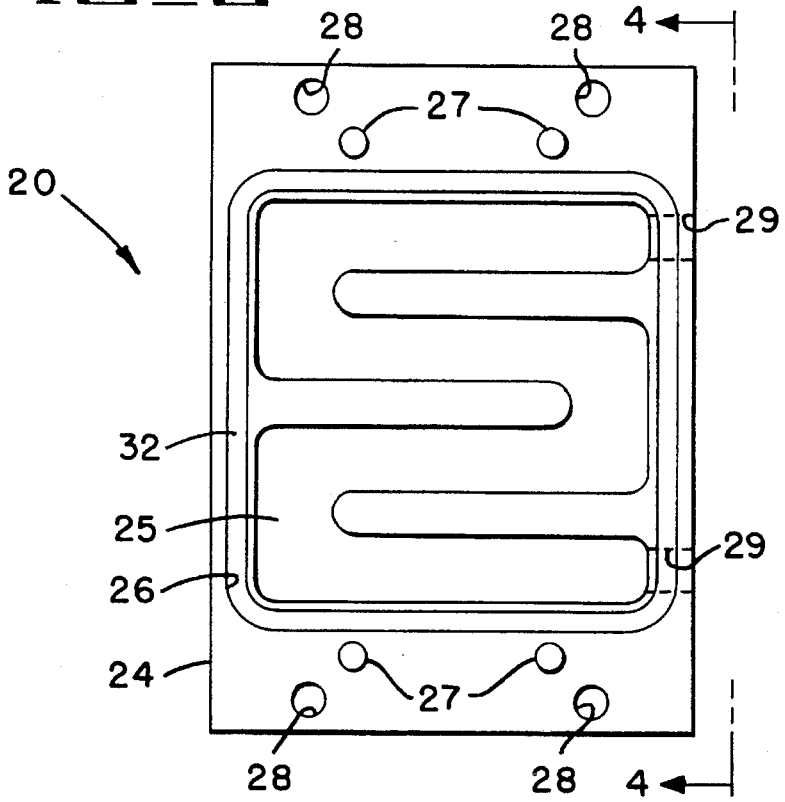
FIG. 3 is a view of a spacer.
Figure 4:
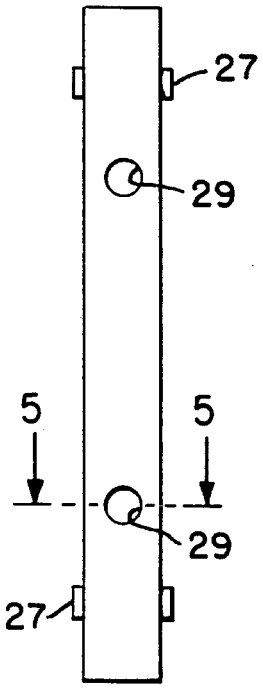
FIG. 4 is an end view of the spacer shown in FIG. 3 along lines 4—4.
Figure 5:
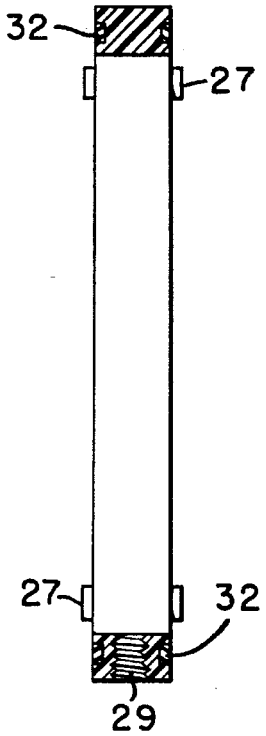
FIG. 5 is a cross sectional view of the spacer shown in FIG. 4 along lines 5—5.
Figure 5:
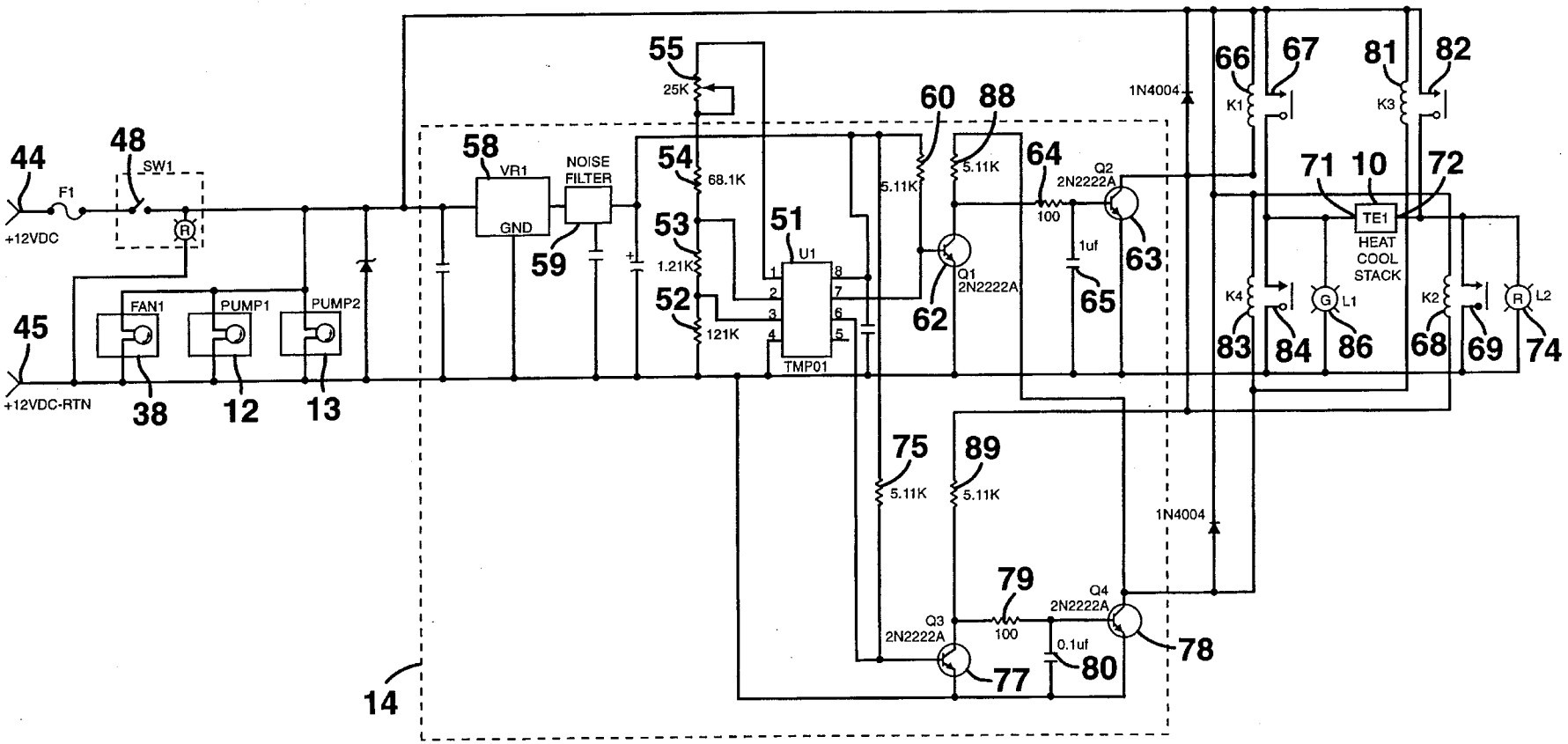

FIGS. 3, 4 and 5 are more detailed views of a spacer 20. The spacers 20 are formed from a hard plastic, such as PVC or ABS plastics. The spacer 20 has a body 24 with a channel 25, O-ring grooves 26, alignment tabs 27, and alignment holes 28. Fluid ports 29 are in fluid connection with the channel 25.

An O-ring 32 is placed in each O-ring groove 26. A thermoelectric module 18 is placed on each side of the spacer 20. The alignment tabs 27 are used to align the thermoelectric modules 18 against the spacer 20 so that the surface of a thermoelectric module completely covers the channel 25 and the O-ring 32, forming a leak proof seal. Clamping bolts 34 are placed through the alignment holes 28 of the spacers 29 to provide alignment between the spacers 20 and to provide a clamping to maintain a leak proof seal. Because the spacers 20 are made of a rigid material, there is less distortion of the spacers 20, meaning that it is easier to align and assemble the thermoelectric stack 10, leaking is reduced, and flow paths are kept at a uniform size increasing efficiency.

A first fluid circuit goes from the first fluid pump 12 to channels 25 adjacent to first temperature surfaces, to the temperature controlled element 15, through the temperature controller, and then back to the first fluid pump 12. A second fluid circuit goes from the second fluid pump 13 to the channels 25 adjacent to the second temperature surfaces, to the heat exchanger 11 and then back to the second fluid pump 13.

FIG. 6 is a schematic view of the temperature controller 14 showing the electrical connection between the temperature controller 14 and the first fluid pump 12, the second fluid pump 13, and a fan 38 for the heat exchanger 11, and the thermoelectric stack 10. A power source provides a 12 volt DC positive lead 44 and return or ground 45. A power switch 48 is provided near the positive lead 44, so that when the power switch 48 is closed it provides power to the fan 38, first fluid pump 12, second fluid pump 13, and the temperature controller 14.

Figure 7:
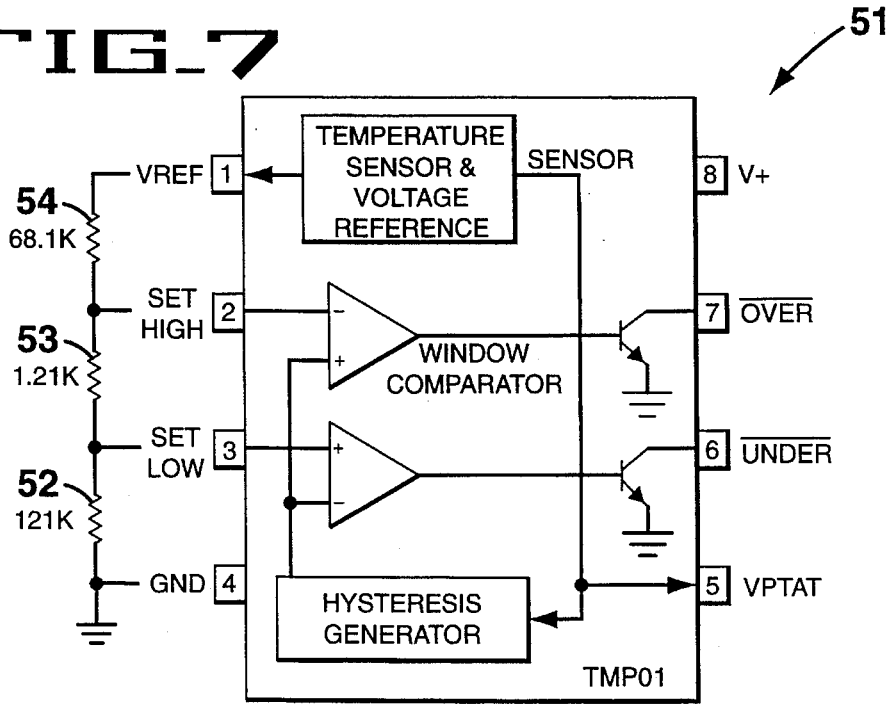
FIG. 7 is a schematic view of the temperature controller chip.

The temperature controller 14 uses a temperature controller chip 51, which in this embodiment is the TMP01 chip manufactured by Analog Devices. FIG. 7 is a schematic view of the TMP01 chip. The TMP01 chip is a temperature sensor which generates a voltage output proportional to absolute temperature and a control signal from one of two outputs when the device is either above or below a specific temperature range. Pin 1 is use for a reference voltage which determines the reference temperature desired. Pin 2 uses a set high voltage that determines the high trigger temperature, which is the temperature above the reference temperature which will connect pin 7 to ground. Pin 3 uses a set low voltage that determines the low trigger temperature, which is the temperature below the reference temperature which will connect pin 6 to ground.

The return lead 45 is electrically connected directly to pin 4 of the temperature controller chip 51 The return lead 45 is electrically connected to pin 3 of the temperature controller chip 51 through a first resistor 52. Pin 2 of the temperature controller chip 51 is connected to the return lead 45 through the first resistor 52 and a second resistor 53. Pin 1 of the temperature controller chip 51 is connected to the return lead 45 through the first resistor 52, the second resistor 53, a third resistor 54 and a variable resistor 55. The positive lead 44 is electrically connected to a voltage regulator 58, which drops the voltage from 12 volts to 0.8 volts. Pin 8 of the temperature controller chip 51 is connected to the voltage regulator 58, through a noise filter 59.

The base of a first transistor 62 is electrically connected directly to pin 7 of the temperature controller chip 51 and to the output side of the voltage regulator 58 through a fourth resistor 60. The emitter of the first transistor 62 is directly connected to the return lead 45. The collector of the first transistor 62 is connected to the base of a second transistor 63 through a fifth resistor 64. A first capacitor 65 is electrically connected between the base of the second transistor 63 and the return lead 45. The emitter of the second transistor 63 is directly connected to the return lead 45. The collector of the second transistor 63 is electrically connected through a first relay coil 66 and a second relay coil 68 in parallel to the positive lead 44. The first relay coil 66 controls a first control switch 67. The second relay coil 68 controls a second control switch 69. The first control switch 67 is electrically connected between first leads 71 of the thermoelectric stack 10 and the positive lead 44. The second control switch 69 is electrically connected between second leads 72 of the thermoelectric stack 10 and the return lead 45. A red lamp 74 is placed in parallel with the second control switch 69.

The base of a third transistor 77 is electrically connected directly to pin 6 of the temperature controller chip 51 and to the output side of the voltage regulator 58 through a sixth resistor 75. The emitter of the third transistor 77 is directly connected to the return lead 45. The collector of the third transistor 77 is connected to the base of a fourth transistor 78 through a seventh resistor 79. A second capacitor 80 is electrically connected between the base of the fourth transistor 78 and the return lead 45. The emitter of the fourth transistor 78 is directly connected to the return lead 45. The collector of the fourth transistor 78 is electrically connected through a third relay coil 81 and a fourth relay coil 83 in parallel to the positive lead 44. The third relay coil 81 controls a third control switch 82. The fourth relay coil 83 controls a fourth control switch 84. The third control switch 82 is electrically connected between second leads 72 of the thermoelectric stack 10 and the positive lead 44. The fourth control switch 84 is electrically connected between first leads 71 of the thermoelectric stack 10 and the return lead 45. A green lamp 86 is placed in parallel with the fourth control switch 84.

The collector of the first transistor 62 is electrically connected through an eighth resistor 88 to the collector of the is fourth transistor 78. The collector of the third transistor 77 is electrically connected through a ninth resistor 89 to the collector of the second transistor 63.

The temperature controlled element 15, in FIG. 1, may be a vest as shown, or a car seat, or electronic components, or any other object where maintenance of temperature is important.

In operation, the power switch 48 is closed to provide power to the fan 38, first fluid pump 12, second fluid pump 13, and the temperature controller 14. This causes the first fluid pump 12 to pump fluid through the first fluid circuit and the second fluid pump to pump fluid through the second fluid circuit. The fluid in the first fluid circuit goes from the first fluid pump 12 to channels 25 adjacent to first temperature surfaces, to the temperature controlled element 15, through the temperature controller, and then back to the first fluid pump 12. The fluid in the second fluid circuit goes from the second fluid pump 13 to the channels 25 adjacent to the second temperature surfaces, to the heat exchanger 11 and then back to the second fluid pump 13. Power passes from the positive lead 44 through the voltage regulator 58, where the voltage is stepped down from 12 volts to 0.8 volts. The voltage regulator is electrically connected to pin 8 of the temperature controller chip 51 to provide power to the temperature controller chip 51. The variable resistor 55 is set for the desired temperature. The second resistor 53 determines the high delta temperature between the set high temperature and the desired temperature, so that when the measured temperature is higher than the desired temperature plus the high delta temperature, pin 7 is connected to the ground. The first resistor 52 determines the low delta temperature between the set low temperature and the desired temperature, so that when the measured temperature is lower than the desired temperature minus the low delta temperature, pin 6 is connected to the ground. The temperature controller chip 51 measures the temperature of the fluid flowing through the first fluid circuit from the temperature controlled element 15.

In the case that the temperature of the fluid flowing through the first fluid circuit from the temperature controlled element 15 is higher than the desired temperature set by the variable resistor 55 plus the high delta temperature set by the second resistor 53 pin 7 is grounded and pin 6 is ungrounded. The grounding of pin 7 causes the voltage at the base of the first transistor 62 to drop, causing the first transistor 62 to resist the flow of current from the collector to the emitter. This causes the voltage at the collector of the first transistor 62 and the base of the second transistor 63 to be high (about 0.8 volts) reducing the resistance from the collector to the emitter of the second transistor 63. This allows current to flow from the positive lead 44 through the first relay coil 66, then through the collector to the emitter of the second transistor 63 and then to the return lead 45. It also allows current to flow from the positive lead 44 through the second relay coil 68, and the red lamp 74, then through the collector to the emitter of the second transistor 63 and then to the return lead 45. The current through the first relay coil 66 creates a magnetic field which closes the first control switch 67. The current through the second relay coil 68 creates a magnetic field which closes the second control switch 69. Since pin 6 is ungrounded, the voltage at the base of the third transistor 77 remains high, causing the third transistor 77 to allow the flow of current from the collector to the emitter. This causes the voltage at the collector of the third transistor 77 and the base of the fourth transistor 78 to drop (to about 0.1 volts) creating a resistance from the collector to the emitter of the fourth transistor 78. This prevents current from flowing from the positive lead. 44 through the third relay coil 81, then through the collector to the emitter of the fourth transistor 78 and then to the return lead 45. It also prevents current from flowing from the positive lead 44 through the fourth relay coil 78, then through the collector to the emitter of the fourth transistor 78 and then to the return lead 45. Since no current flows through the third relay coil 81 there is no magnetic field, and so the third control switch 82 remains open. Since no current flows through the fourth relay coil 83 there is no magnetic field, and so the fourth control switch 84 remains open.

Since the first and second control switches 67, 69 are closed and the third and fourth control switches 82, 84 are open, current flows from the positive lead 44 through the first control switch 67, to the first leads 71 of the thermoelectric stack 10, to the second leads 72 of the thermoelectric stack 10, through the second control switch 69 and then to the return lead 45. Current flowing from the first leads 71 to the second leads 72 through the thermoelectric stack causes the temperature of the first temperature surfaces of the thermoelectric modules to be at a lower temperature than the second temperature surfaces of the thermoelectric modules. Fluid passing through the second fluid circuit from the second fluid pump 13, to the thermoelectric stack 10, to the heat exchanger and then back to the second fluid pump 13, tends to cool the higher temperature second surfaces of the thermoelectric modules 18. Fluid passing from the first fluid pump 12, is cooled as it passes through the channels 25 of the spacers 20 adjacent to the cooler first temperature surfaces of the thermoelectric modules 18. This cools the fluid, which then passes to the temperature controlled element 15, cooling the temperature controlled element. So this case is the cooling mode.

Once the temperature controlled element 15 is sufficiently cooled, the temperature of the fluid flowing through the first fluid circuit from the temperature controlled element 15 will be between the desired temperature set by the variable resistor 55 plus the high delta temperature determined by the second resistor 53 and the desired temperature set by the variable resistor 55 minus the low delta temperature determined by the first resistor 52. In this case, both pins 6 and 7 of the temperature controller chip 51 will be ungrounded. Since pin 7 is ungrounded, the voltage at the base of the first transistor 62 remains high, causing the first transistor 62 to allow the flow of current from the collector to the emitter. This causes the voltage at the collector of the first transistor 62 and the base of the second transistor 63 to drop (to about 0.1 volts) creating a resistance from the collector to the emitter of the second transistor 63. This prevents current from flowing from the positive lead 44 through the first relay coil 66, then through the collector to the emitter of the second transistor 63 and then to the return lead 45. It also prevents current from flowing from the positive lead 44 through the second relay coil 63, then through the collector to the emitter of the second transistor 63 and then to the return lead 45. Since no current flows through the first relay coil 66 there is no magnetic field, and so the first control switch 67 remains open. Since no current flows through the second relay coil 68 there is no magnetic field, and so the second control switch 69 remains open. Since pin 6 is ungrounded, the voltage at the base of the third transistor 77 remains high, causing the third transistor 77 to allow the flow of current from the collector to the emitter. This causes the voltage at the collector of the third transistor 77 and the base of the fourth transistor 78 to drop (to about 0.1 volts) creating a resistance from the collector to the emitter as of the fourth transistor 78. This prevents current from flowing from the positive lead 44 through the third relay coil 81, then through the collector to the emitter of the fourth transistor 78 and then to the return lead 45. It also prevents current from flowing from the positive lead 44 through the fourth relay coil 78, then through the collector to the emitter of the fourth transistor 78 and then to the return lead 45. Since no current flows through the third relay coil 81 there is no magnetic field, and so the third control switch 82 remains open. Since no current flows through the fourth relay coil 83 there is no magnetic field, and so the fourth control switch 84 remains open.

Since the first, second, third and fourth control switches 67, 69, 82, 84 are open no current flows through the thermoelectric stack. So the fluid passing from the first fluid pump 12, is neither heated or cooled as it passes through the channels 25 of the spacers 20 adjacent to the cooler first temperature surfaces of the thermoelectric modules 18. Thus the fluid, which then passes to the temperature controlled element 15, neither heats nor cools the temperature controlled element. So this case is the satisfactory mode.

In the case that the temperature of the fluid flowing through the first fluid circuit from the temperature controlled element 15 is lower than the desired temperature set by the variable resistor 55 minus the low delta temperature set by the first resistor 52 pin 6 is grounded and pin 7 is ungrounded. The grounding of pin 6 causes the voltage at the base of the third transistor 77 to drop, causing the third transistor 77 to resist the flow of current from the collector to the emitter. This causes the voltage at the collector of the third transistor 77 and the base of the fourth transistor 78 to be high (about 0.8 volts) reducing the resistance from the collector to the emitter of the fourth transistor 78. This allows current to flow from the positive lead 44 through the third relay coil 81, then through the collector to the emitter of the fourth transistor 78 and then to the return lead 45. It also allows current to flow from the positive lead 44 through the fourth relay coil 83 and the green lamp 86, then through the collector to the emitter of the fourth transistor 78 and then to the return lead 45. The current through the third relay coil 81 creates a magnetic field which closes the third control switch 82. The current through the fourth relay coil 83 creates a magnetic field which closes the fourth control switch 84. Since pin 7 is ungrounded, the voltage at the base of the first transistor 62 remains high, causing the first transistor 62 to allow the flow of current from the collector to the emitter. This causes the voltage at the collector of the first transistor 62 and the base of the second transistor 63 to drop (to about 0.1 volts) creating a resistance from the collector to the emitter of the second transistor 63. This prevents current from flowing from the positive lead 44 through the first relay coil 66, then through the collector to the emitter of the second transistor 63 and then to the return lead 45. It also prevents current from flowing from the positive lead 44 through the second relay coil 66, then through the collector to the emitter of the second transistor 63 and then to the return lead 45. Since no current flows through the first relay coil 66 there is no magnetic field, and so the first control switch 67 remains open. Since no current flows through the second relay coil 68 there is no magnetic field, and so the second control switch 69 remains open.

Since the first and second control switches 67, 69 are open and the third and fourth control switches 82, 84 are closed, current flows from the positive lead 44 through the third control switch 82, to the second leads 72 of the thermoelectric stack 10, to the first leads 7 1 of the thermoelectric stack 10, through the fourth control switch 84 and then to the return lead 45. Current flowing from the second leads 72 to the first leads 71 (the reverse of the direction stated in the first case above for the cooling mode) through the thermoelectric stack causes the temperature of the first temperature surfaces of the thermoelectric modules to be at a higher temperature than the second temperature surfaces of the thermoelectric modules. Fluid passing through the second fluid circuit from the second fluid pump 13, to the thermoelectric stack 10, to the heat exchanger and then back to the second fluid pump 13, tends to heat the lower temperature second surfaces of the thermoelectric modules 18. Fluid passing from the first fluid pump 12, is heated as it passes through the channels 25 of the spacers 20 adjacent to the hotter first temperature surfaces of the thermoelectric modules 18. This heats the fluid, which then passes to the temperature controlled element 15, heating the temperature controlled element. So this case is the heating mode.

If the temperature controlled switch 51 malfunctions and both pins 6 and 7 are grounded indicating the need for both cooling and heating, the temperature controller, prevents this malfunction from shorting out the entire system. If the temperature controller 14 is in the heating mode then the chip malfunctions by going from having just pin 6 grounded to having both pins 6 and 7 grounded. Since pin 6 was previously grounded, the temperature controller 14 was in the cooling mode. As described above, in the cooling mode, current passes from the collector to the emitter of the fourth transistor 78, causing the voltage at the collector of the fourth transistor 78 to drop (to about 0.1 volts). This causes, through the circuit containing the eight resistor, the voltage at the base of the second transistor 63 to drop (to about 0.1 volts) This prevents current from flowing from the collector to the emitter of the second transistor 63. This prevents the first and second relay coils 66, 68 from closing the first and second control switches 67, 69. This prevents the shorting of the system.

If the temperature controller 14 is in the cooling mode then the chip malfunctions by going from having just pin 7 grounded to having both pins 6 and 7 grounded. Since pin 7 was previously grounded, the temperature controller 14 was in the heating mode. As described above, in the heating mode, current passes from the collector to the emitter of the second transistor 63, causing the voltage at the collector of the second transistor 63 to drop (to about 0.1 volts). This causes, through the circuit containing the ninth resistor, the voltage at the base of the fourth transistor 78 to drop (to about 0.1 volts) This prevents current from flowing from the collector to the emitter of the fourth transistor 78. This prevents the third and fourth relay coils 81, 83 from closing the third and fourth control switches 82, 84. This prevents the shorting of the system.

If the temperature controller 14 is in the satisfactory mode, then the chip malfunctions by going from having pins 6 and 7 ungrounded to having pins 6 and 7 grounded. The RC product of the circuit connected to pin 7 is less than the RC product of the for the circuit connected to pin 6. Because of this difference in the RC product, the temperature controller will first go into the cooling mode, which will then prevent the shorting of the system from the cooling mode as described above.

Figure 8:
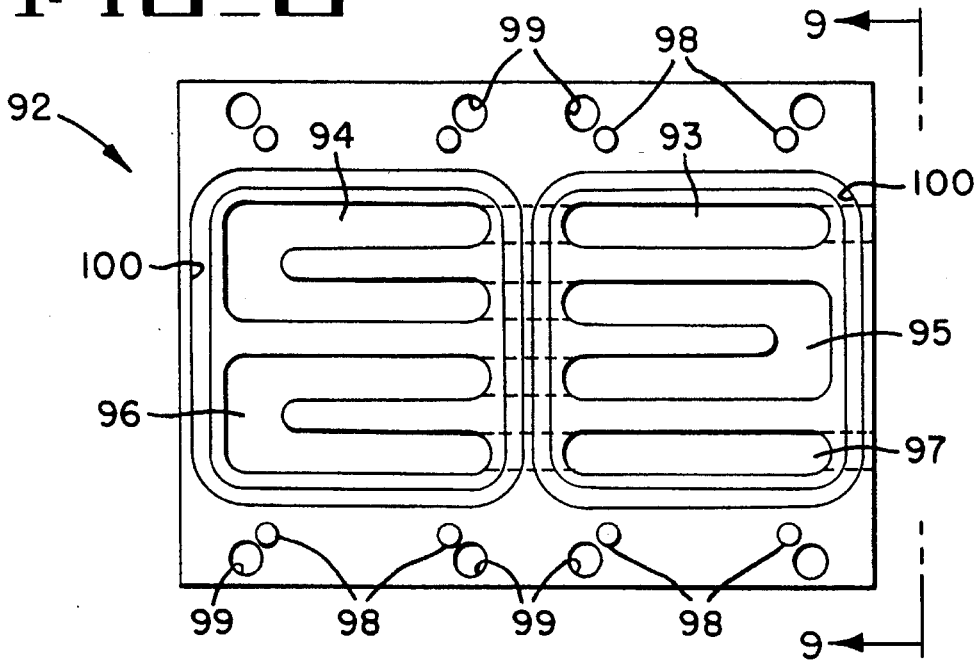
FIG. 8 is a view of a dual spacer.
Figure 9:
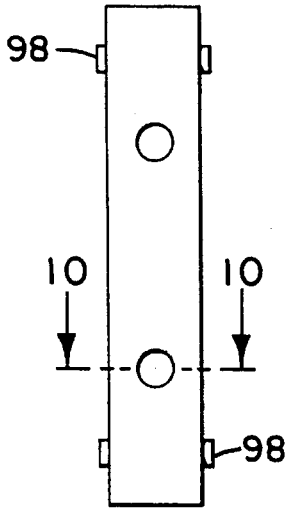
FIG. 9 is an end view of the dual spacer of FIG. 8 along lines 9—9.
Figure 10:
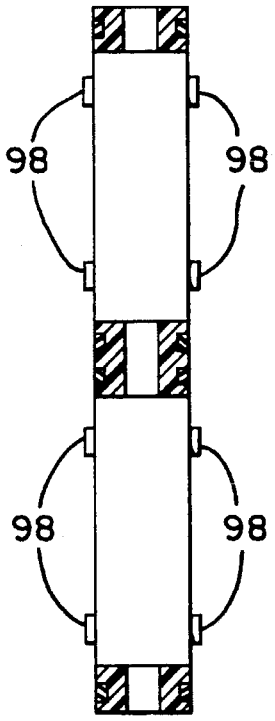
FIG. 10 is a cross sectional view of the dual spacer shown in FIG. 8 along lines 10—10.

FIGS. 8, 9 and 10 illustrate a dual spacer 92 that may be used in another embodiment of the invention. The dual spacer 92 can hold two thermoelectric modules on each side of the dual spacer 92. Fluid would flow into a linear first channel 93 in the spacer 92 and between first and second thermoelectric modules, then to a U-shaped second channel 94 between third and fourth thermoelectric modules, then to a third U-shaped channel 95, between the first and second thermoelectric modules, then to a U-shaped fourth channel 96 between the third and fourth thermoelectric modules, then to a linear fifth channel 97 between the first and second thermoelectric modules. The dual spacer 92 has eight alignment tabs 98 and eight alignment holes 99 which have the same function as the alignment tabs and alignment holes of the previous embodiment. The dual spacer 92 has four O-ring grooves 100 so that each thermoelectric module is sealed with an O-ring. This dual spacer 92 of solid material provides a stack with twice as many thermoelectric modules, and is used in a system that is otherwise the same as in the previous embodiment.

Although the best modes contemplated for carrying out the present invention have been herein shown and described, it will be understood that modification and variation may be made without departing from what is regarded to be the subject matter of the invention.

What is claimed is:

1. An apparatus for heating and cooling a temperature controlled element, comprising:

an electrical power source with a power lead and return lead;

a heat exchanger;

a thermoelectric stack with first electrical leads and second electrical leads;

a first fluid pump in fluid connection between the thermoelectric stack and the temperature controlled element:

a second fluid pump in fluid connection between the heat exchanger and the thermoelectric stack; and means for determining whether the temperature controlled element requires heating or cooling and applying a voltage across the thermoelectric stack to provide the required heating or cooling to the temperature controlled element, electrically connected to the thermoelectric stack and the power source, and wherein the heating occurs by flowing current through the thermoelectric stack in a first direction and cooling occurs by flowing current through the thermoelectric stack in a second direction which is the reverse of the first direction, wherein the means for determining whether the temperature controlled element requires heating or cooling, comprises:

a voltage regulator, electrically connected to the power lead;

a temperature controller unit;

a first transistor with a base, collector, and emitter, wherein the base is electrically connected to the temperature controller unit and the emitter is electrically connected to the return lead;

a second transistor with a base, collector, and emitter, wherein the base is electrically connected to the collector of the first transistor and the emitter is electrically connected to the return lead;

a first relay coil electrically connected between the power lead and the collector of the second transistor;

a second relay coil electrically connected between the power lead and the collector of the second transistor;

a third transistor with a base, collector, and emitter, wherein the base is electrically connected to the temperature controller unit and the emitter is electrically connected to the return lead;

a fourth transistor with a base, collector, and emitter, wherein the base is electrically connected to the collector of the third transistor and the emitter is electrically connected to the return lead;

a third relay coil electrically connected between the power lead and the collector of the fourth transistor; and a fourth relay coil electrically connected between the power lead and the collector of the fourth transistor.

2. The apparatus, as recited in claim 1, further comprising:

a first resistor electrically connected between the base of the second transistor and the collector of the fourth transistor; and a second resistor electrically connected between the base of the fourth transistor and the collector of the second transistor.

3. The apparatus, as recited in claim 2, further comprising:

a first control switch, controlled by the first relay coil, wherein the first control switch is electrically connected between the power lead and the first electrical leads of the thermoelectric stack;

a second control switch, controlled by the second relay coil, wherein the second control switch is electrically connected between the second electrical leads of the thermoelectric stack and the return lead;

a third control switch, controlled by the third relay coil, wherein the third control switch is electrically connected between the power lead and the second electrical leads of the thermoelectric stack; and a fourth control switch, controlled by the fourth relay coil, wherein the fourth control switch is electrically connected between the first electrical leads of the thermoelectric stack and the return lead.

4. The apparatus, as recited in claim 3, wherein the temperature controller unit is a TMP01 chip.

5. The apparatus, as recited in claim 3, wherein the thermoelectric stack comprises:

a plurality of thermoelectric modules;

a plurality of spacers made of a hard plastic material between the plurality of thermoelectric modules; and a plurality of O-rings between the plurality of spacers and the plurality of thermoelectric modules.

6. The apparatus, as recited in claim 5, wherein the spacers comprise:

channels passing through the spacers;

an O-ring groove surrounding the channels alignment tabs around the O-ring groove for aligning the thermoelectric modules on the spacers; and alignment holes.

7. The apparatus, as recited in claim 6, further comprising:

end plates placed at ends of the thermoelectric stack, wherein the end plates have alignment holes; and a plurality of bolts passing through the alignment holes of the end plates and the alignment holes of the plurality of spacers.

8. An apparatus for heating and cooling a temperature controlled element, comprising:

an electrical power source with a .power lead and return lead;

a heat exchanger;

a thermoelectric stack with first electrical leads and second electrical leads, wherein the thermoelectric stack comprises:

a plurality of thermoelectric modules;

a plurality of spacers made of a hard plastic materials between the plurality of thermoelectric modules; and a plurality of O-rings between the plurality of spacers and the plurality of thermoelectric modules;

a first fluid pump in fluid connection between the thermoelectric stack and the temperature controlled element;

a second fluid pump in fluid connection between the heat exchanger and the thermoelectric stack; and means for determining whether the temperature controlled element requires heating or cooling and applying a voltage across the thermoelectric stack to provide the required heating or cooling to the temperature controlled element, electrically connected to the thermoelectric stack and the power source, and wherein the heating occurs by flowing current through the thermoelectric stack in a first direction and cooling occurs by flowing current through the thermoelectric stack in a second direction which is the reverse of the first direction.

9. An apparatus for heating and cooling a temperature controlled element, comprising:

an electrical power source with a power lead and return lead;

a heat exchanger;

a thermoelectric stack with first electrical leads and second electrical leads, wherein the thermoelectric stack comprises:

a plurality of thermoelectric modules;

a plurality of spacers made of a hard plastic materials between the plurality of thermoelectric modules, wherein the spacers have alignment tabs for aligning the thermoelectric modules on the spacers, and wherein the spacers have alignment holes; and a plurality of O-rings between the plurality of spacers and the plurality of thermoelectric modules;

a first fluid pump in fluid connection between the thermoelectric stack and the temperature controlled element;

a second fluid pump in fluid connection between the heat exchanger and the thermoelectric stack; and means for determining whether the temperature controlled element requires heating or cooling and applying a voltage across the thermoelectric stack to provide the required heating or cooling to the temperature controlled element, electrically connected to the thermoelectric stack and the power source, and wherein the heating occurs by flowing current through the thermoelectric stack in a first direction and cooling occurs by flowing current through the thermoelectric stack in a second direction which is the reverse of the first direction.

10. The apparatus, as recited in claim 9, further comprising:

end plates placed at ends of the thermoelectric stack, wherein the end plates have alignment holes; and a plurality of bolts passing through the alignment holes of the end plates and the alignment holes of the plurality of spacers.

11. The apparatus as recited in claim 10, wherein the spacers have four O-ring grooves for holding four O-rings.

* * * * *